US009364937B2

(12) United States Patent
Taylor et al.

(10) Patent No.: US 9,364,937 B2
(45) Date of Patent: Jun. 14, 2016

(54) SELF-CENTERING VISE

(71) Applicants: Chris Taylor, San Diego, CA (US); Steve Grangetto, San Diego, CA (US)

(72) Inventors: Chris Taylor, San Diego, CA (US); Steve Grangetto, San Diego, CA (US)

( * ) Notice: Subject to any disclaimer, the term of this patent is extended or adjusted under 35 U.S.C. 154(b) by 300 days.

(21) Appl. No.: 14/059,166

(22) Filed: Oct. 21, 2013

(65) Prior Publication Data

US 2014/0131933 A1 May 15, 2014

Related U.S. Application Data

(60) Provisional application No. 61/726,853, filed on Nov. 15, 2012, provisional application No. 61/807,986, filed on Apr. 3, 2013.

(51) Int. Cl.

| | |
|---|---|
| ***B25B 1/02*** | (2006.01) |
| ***B25B 1/10*** | (2006.01) |
| ***B25B 1/24*** | (2006.01) |

(52) U.S. Cl.

CPC . *B25B 1/103* (2013.01); *B25B 1/24* (2013.01); *B25B 1/241* (2013.01); *B25B 1/2489* (2013.01)

(58) Field of Classification Search

CPC ..... B25B 1/103; B25B 1/2489; B25B 1/24; B25B 1/241; B25B 1/2405; B25B 1/00; B25B 1/10; B25B 1/2421; B25B 5/003; B25B 11/02; Y10T 279/1986; Y10T 279/1973; Y10T 279/1913

See application file for complete search history.

(56) References Cited

U.S. PATENT DOCUMENTS

| | | | | |
|---|---|---|---|---|
| 1,549,278 | A | 8/1925 | Sundstrand | |
| 3,834,435 | A | 9/1974 | McCord, Jr. | |
| 4,251,066 | A | 2/1981 | Bowling | |
| 4,429,887 | A | 2/1984 | Smith | |
| 6,957,809 | B1 | 10/2005 | Ferrara et al. | |
| 8,020,877 | B2 * | 9/2011 | Lang | B25B 1/103 279/112 |
| 8,158,242 | B2 | 4/2012 | Nishihata et al. | |
| 8,322,699 | B2 | 12/2012 | Prell et al. | |
| 2010/0219573 | A1 | 9/2010 | O'Rell et al. | |
| 2012/0068393 | A1 | 3/2012 | Van de Voss et al. | |

FOREIGN PATENT DOCUMENTS

| | | | | |
|---|---|---|---|---|
| IT | 0742081 | A2 * | 11/1996 | B25B 1/103 |

* cited by examiner

*Primary Examiner* — Monica Carter
*Assistant Examiner* — Nirvana Deonauth
(74) *Attorney, Agent, or Firm* — Mark Wisnosky

(57) ABSTRACT

A tooling fixture that provides a self-centering vise to hold a work piece is described. The design provides a means to allow a centering adjustment of the clamping surfaces that is integrated into the central support structure for the threaded spindle.

4 Claims, 13 Drawing Sheets

SELF-CENTERING VISE

CROSS-REFERENCE TO RELATED APPLICATIONS

This application claims priority to U.S. Provisional application 61/726,853, titled Self-centering Vise by the same inventors, filed on 15 Nov. 2012 and to U.S. Provisional application 61/807,986, titled Self-centering Vise by the same inventors filed on 3 Apr. 2013.

BACKGROUND OF THE INVENTION

1. Technical Field

The present invention relates to a self-centering tooling fixture for accurately fixing a workpiece on a worktable for machining.

2. Related Background Art

A tooling fixture is used to hold a workpiece during intricate machining such as 5 axis machining. The fixture system requires that the workpiece be held securely and precisely and provides access to a machine tool to all facets of the workpiece. Preferably it is possible to prepare the raw stock and easily and removably mount the stock in the fixture to present to a machine to create a part. Self-centering vises are known, which comprise a body, an externally threaded spindle that is mounted rotatably about its longitudinal axis, and two sliding blocks screwed onto the threaded spindle and containing clamping surfaces to engage the workpiece. The spindle has a right-handed external thread at one end and a left-handed external thread at the opposite end so as to cause the sliding blocks to move towards or away from each other when the spindle is rotated. Such vises include means for differentially adjusting the position of one of the sliding blocks in order to precisely position the center of the clamping aperture between the blocks relative to the body that is normally affixed to a machine worktable. The adjustment mechanism for this centering adjustment are normally integrated into one of the sliding blocks.

DISCLOSURE OF THE INVENTION

A tooling fixture that provides a self-centering vise to hold a work piece is described. The design provides a means to allow a precision centering adjustment of the clamping surfaces that is integrated into the central support structure for the threaded spindle. The threaded spindle includes a central boss that floats freely within central support. Fine-threaded collars are threaded into the central support that fully enclose and constrain the central boss on the threaded spindle. The longitudinal position of the threaded spindle within the central support can therefore be adjusted by adjusting the positions of the fine-threaded collars, thereby providing a precise centering adjustment to the positions of the sliding blocks. A gap in one side of the central support allows the adjustment of the collars to be locked by tightening a central support mounting screw.

BRIEF DESCRIPTION OF THE DRAWINGS

Features are numbered equivalently through all drawings.

MODES FOR CARRYING OUT THE INVENTION

Figure 1:
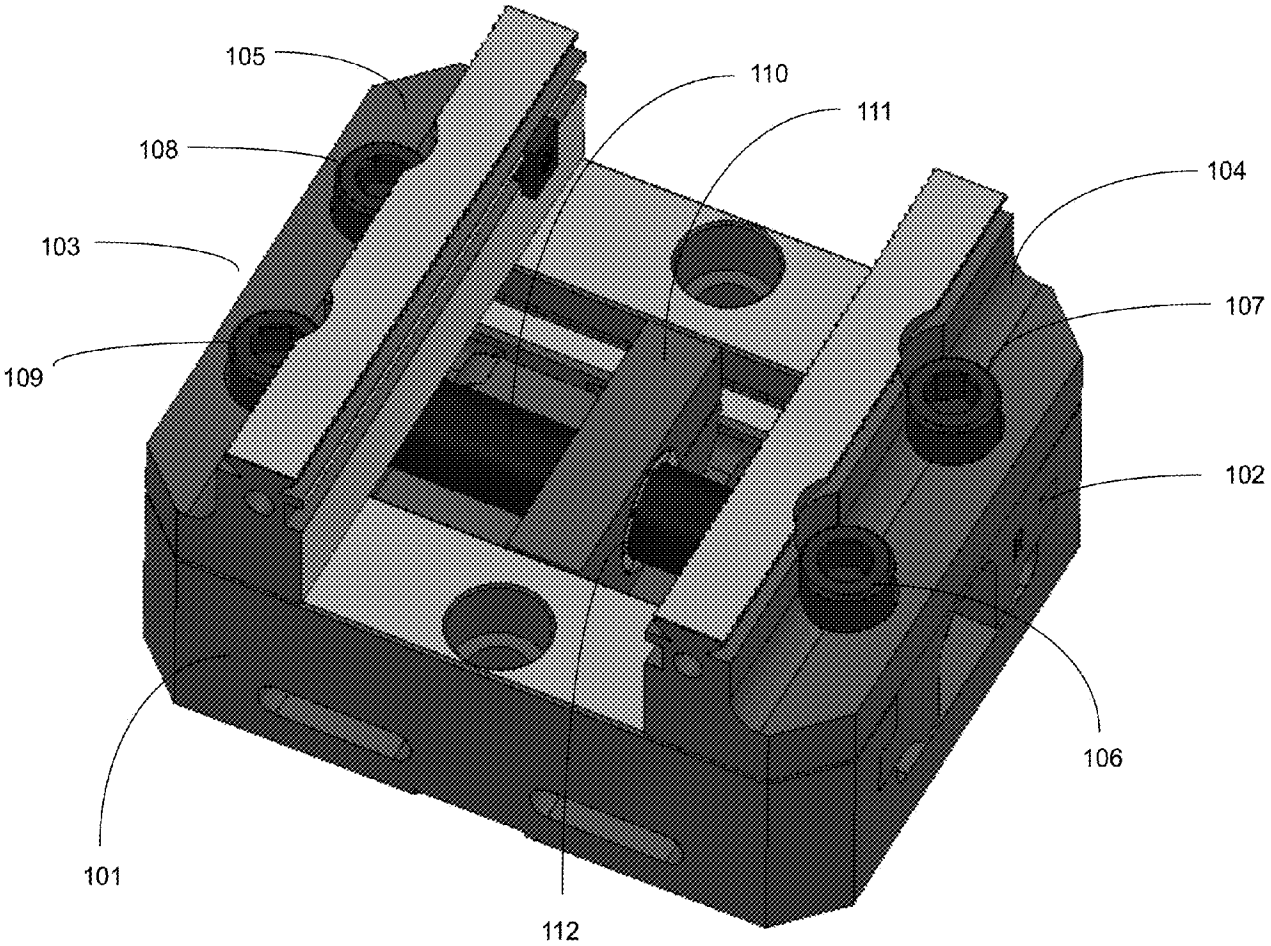
FIG. 1 is a shaded solid diagram of an embodiment of the tooling fixture.
Figure 2:
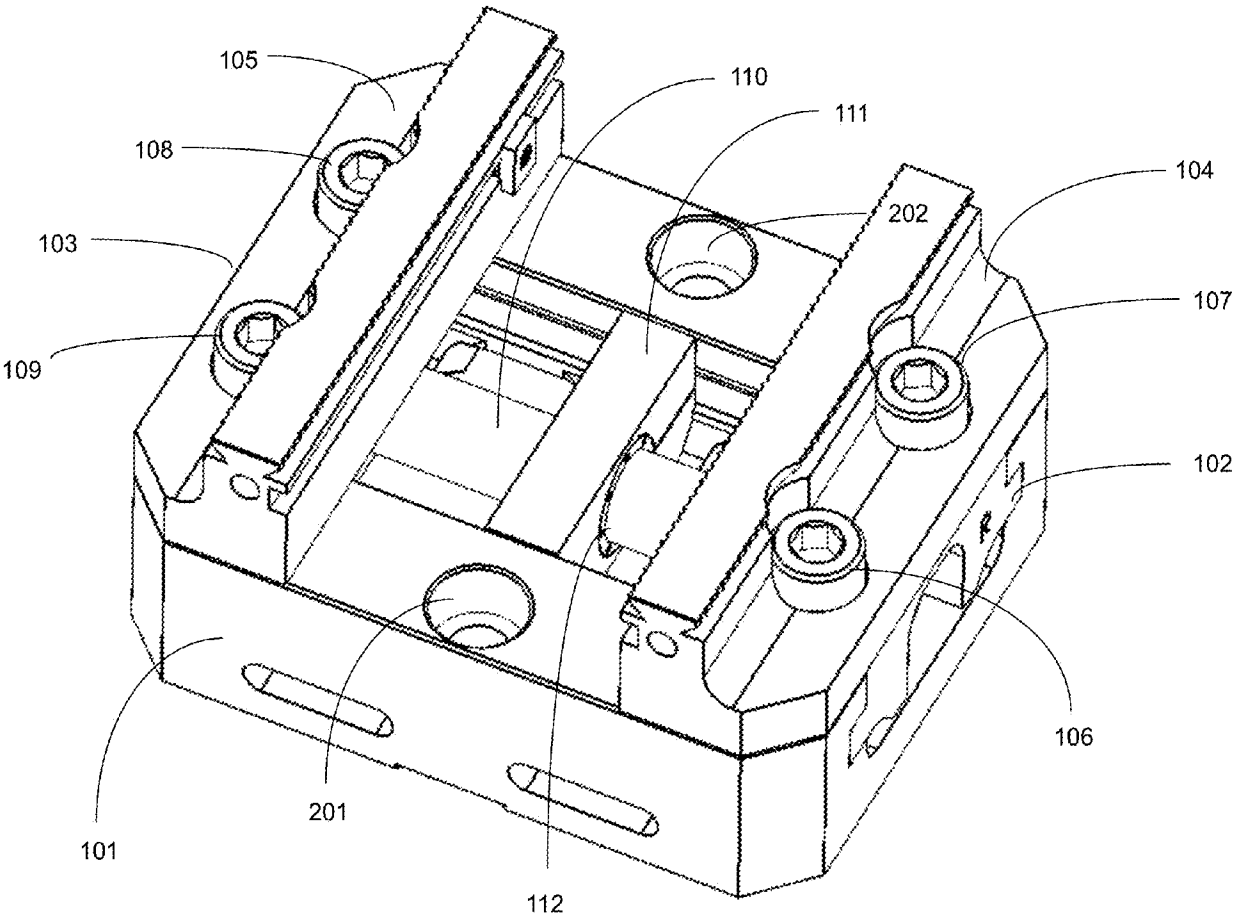
FIG. 2 is a line drawing of the model drawing of FIG. 1.

Referring to FIG. 1, a tooling fixture is shown. The tooling fixture comprises a body 101 and right and left sliding blocks 102 and 103, respectively. The sliding blocks 102 and 103 ride within guide slots machined into the body 101 and include jaws 104 and 105 that are attached to the top surfaces of sliding blocks 102 and 103 using screws 106-109. The surfaces on the jaws in contact with the top surfaces of the sliding blocks 102, 103 are the attachment surfaces of the jaws. The sliding blocks are threaded onto an externally threaded spindle 110 that is supported by center support 111 by means of adjustable collars 112 which allow for a centering adjustment of the sliding blocks 102 and 103. Referring to FIG. 2, the same fixture as seen in FIG. 1 is shown. Features with the same numbers as those in FIG. 1 have already been described. The body 101 includes holes 201 and 202 that allow for the insertion of screws to mount the fixture to a work table.

Figure 3:
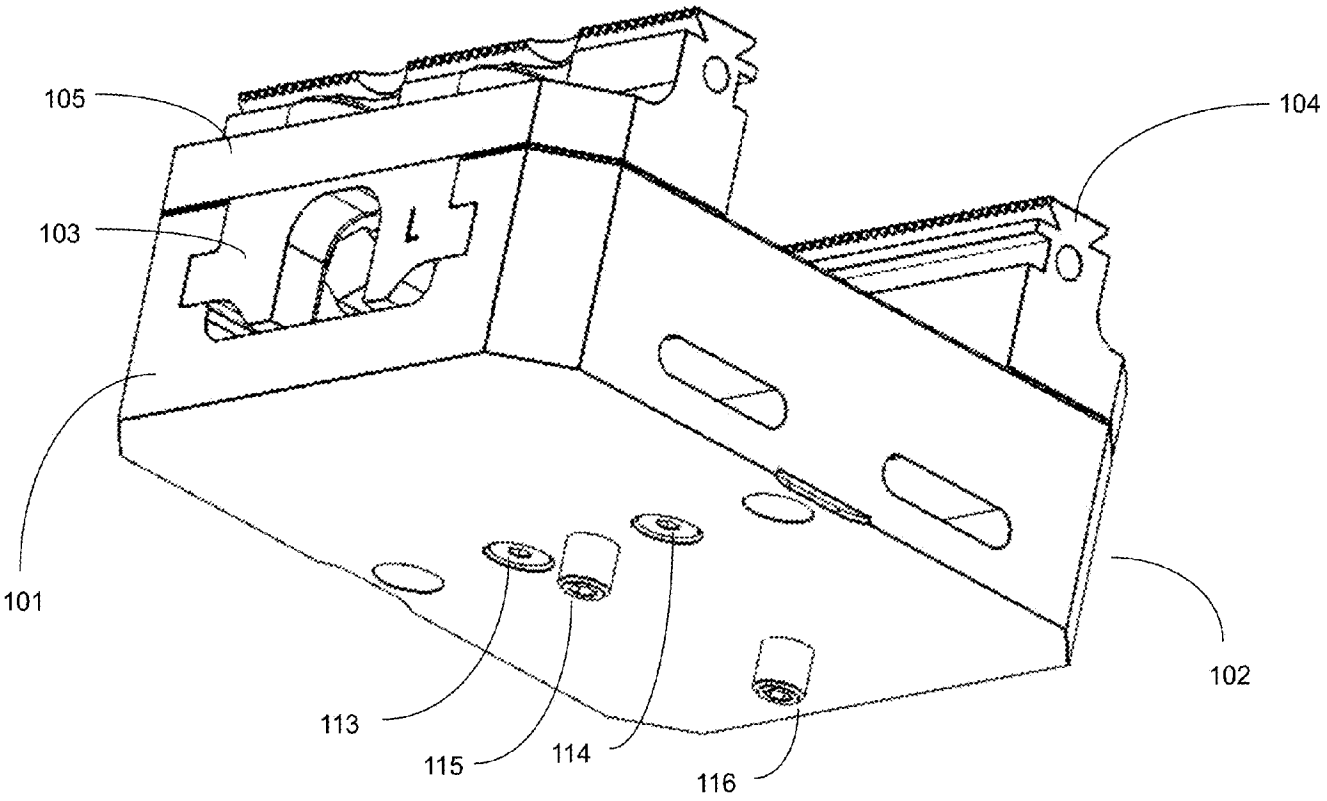
FIG. 3 is an alternate perspective view of the fixture of FIG. 2.

Referring to FIG. 3 a perspective drawing from another angle is provided that more clearly shows the left sliding block 103. Again features numbered less than 113 have already been described. The fixture body 101 further includes mounting screws 113 and 114 for the center support 111 and alignment pins 115 and 116 that are intended to fit within an appropriate slot (not shown) on the work table.

Figure 4:
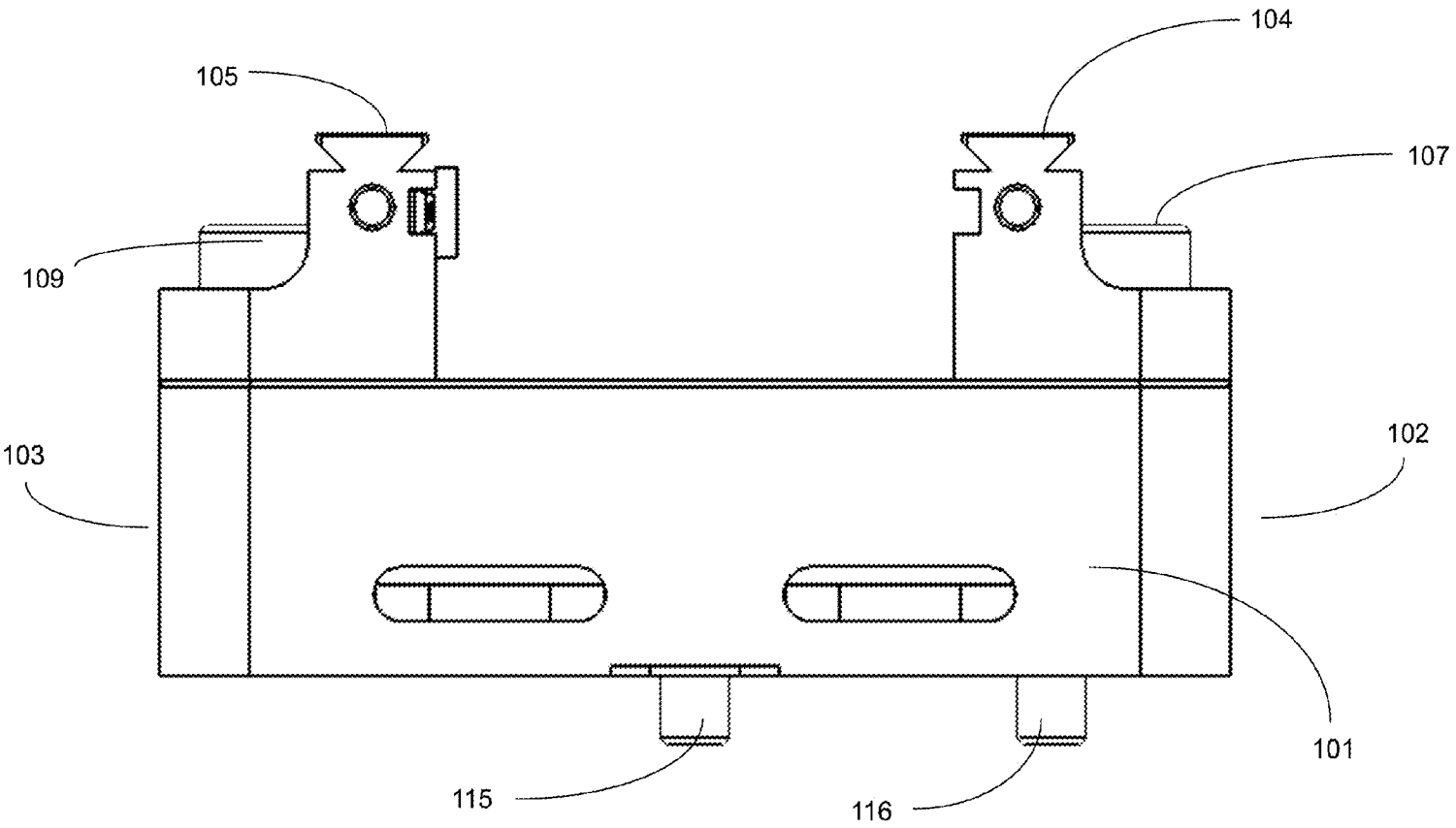
FIG. 4 is a front view of fixture of FIGS. 1-3.
Figure 5:
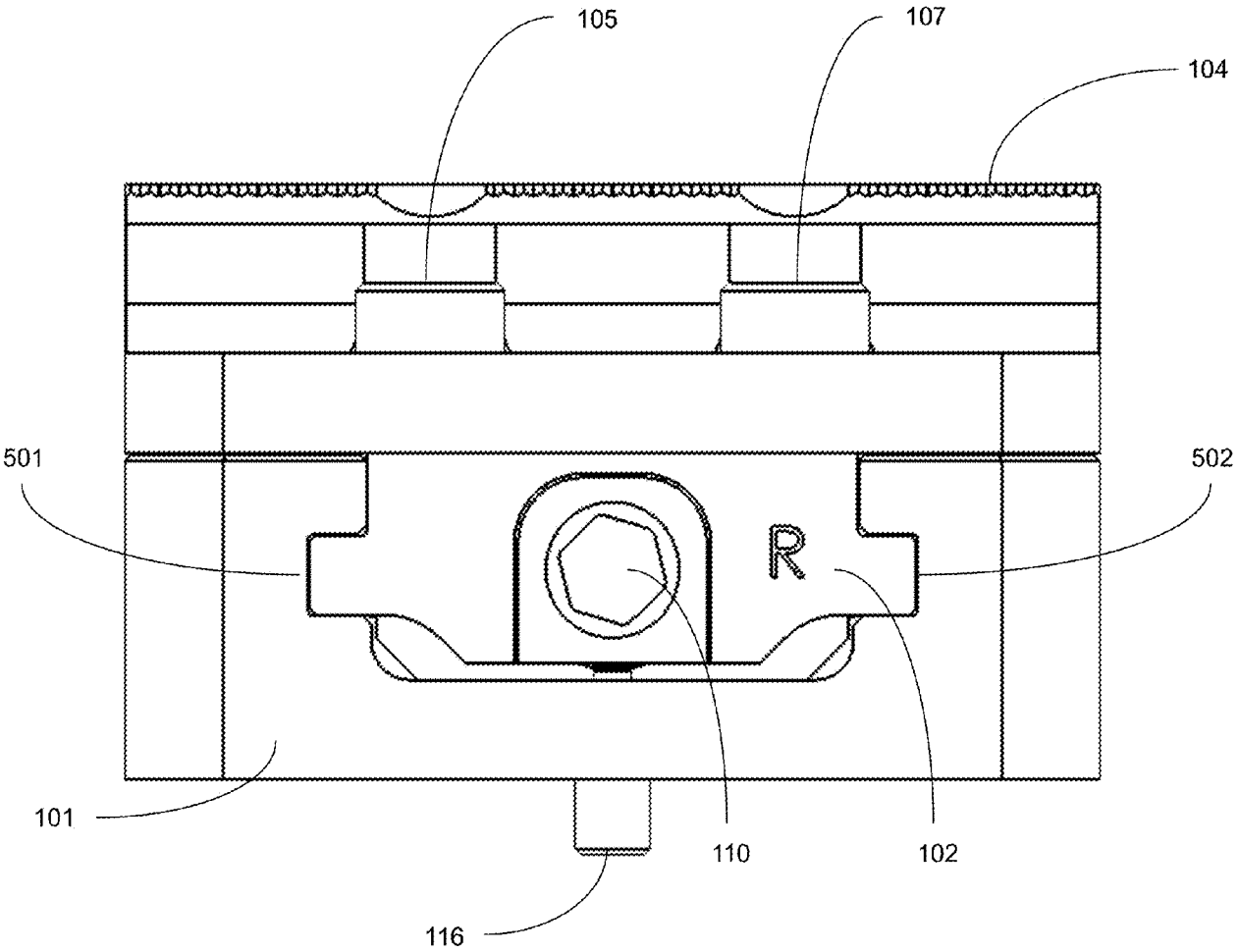
FIG. 5 is a side view of fixture of FIGS. 1-3.
Figure 6:
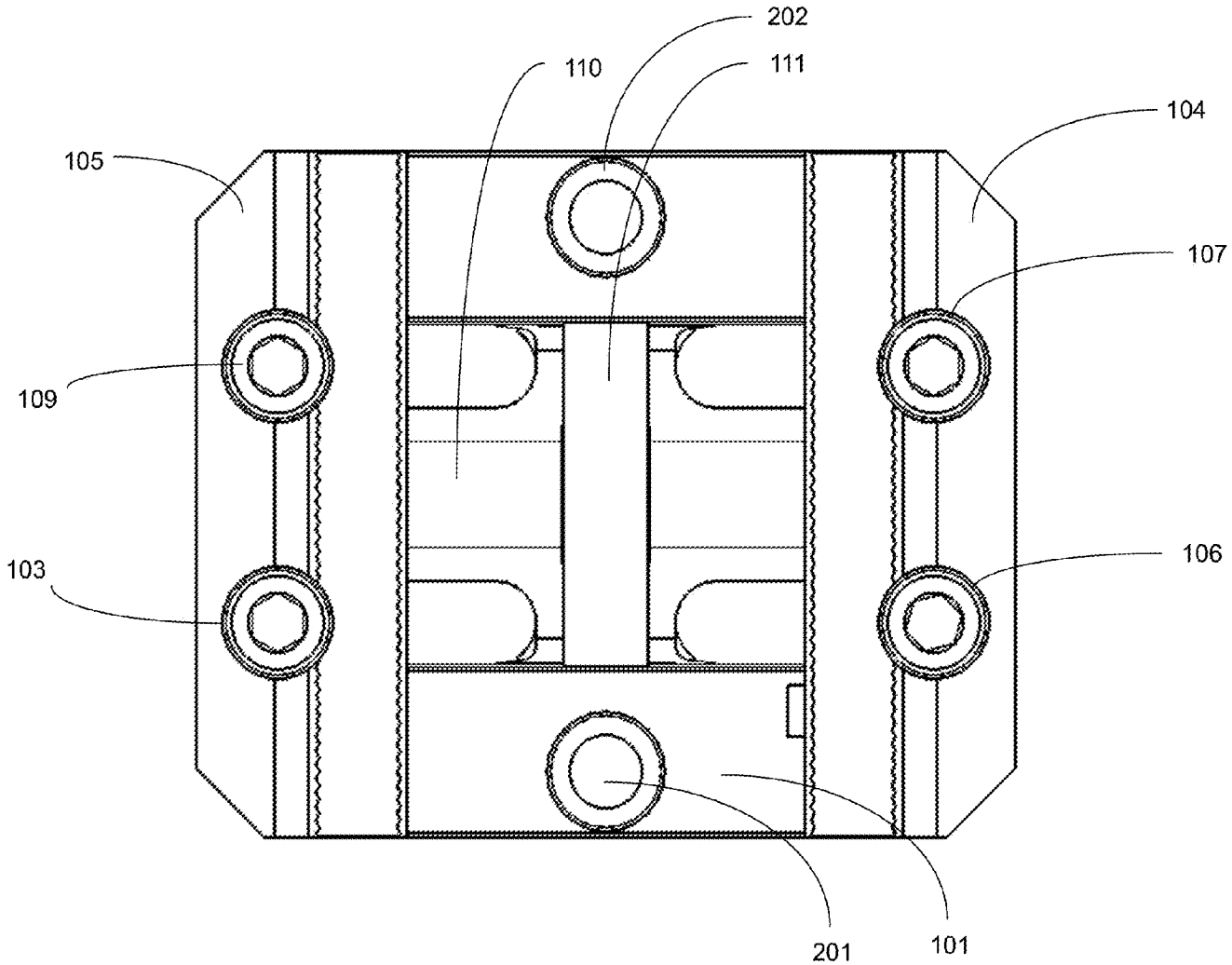
FIG. 6 is a top view of the same fixture.
Figure 7:
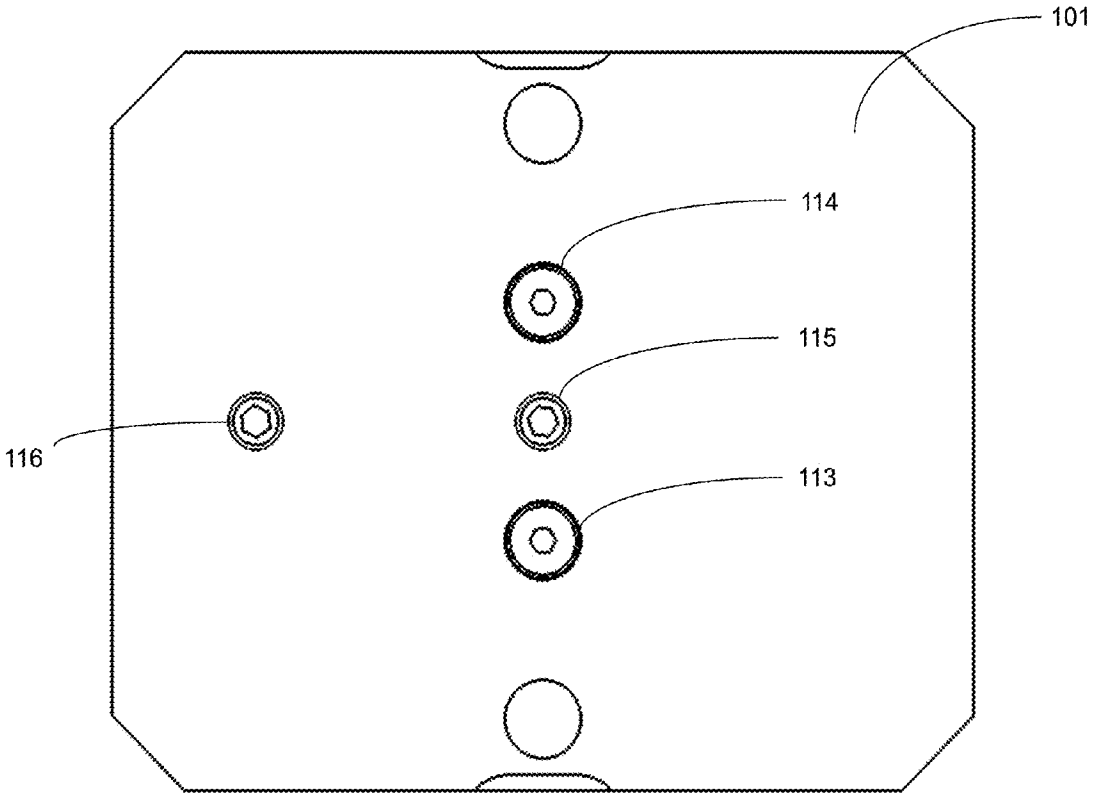
FIG. 7 is a bottom view of the same fixture

FIG. 4 shows a front view of the fixture. FIG. 5 shows a right side view of the fixture that clearly shows the guide slots 501 and 502 for the sliding blocks that are machined into the body 101. FIGS. 6 and 7 show top and bottom views of the fixture and more clearly illustrate the locations of elements 101 through 116.

Figure 8:
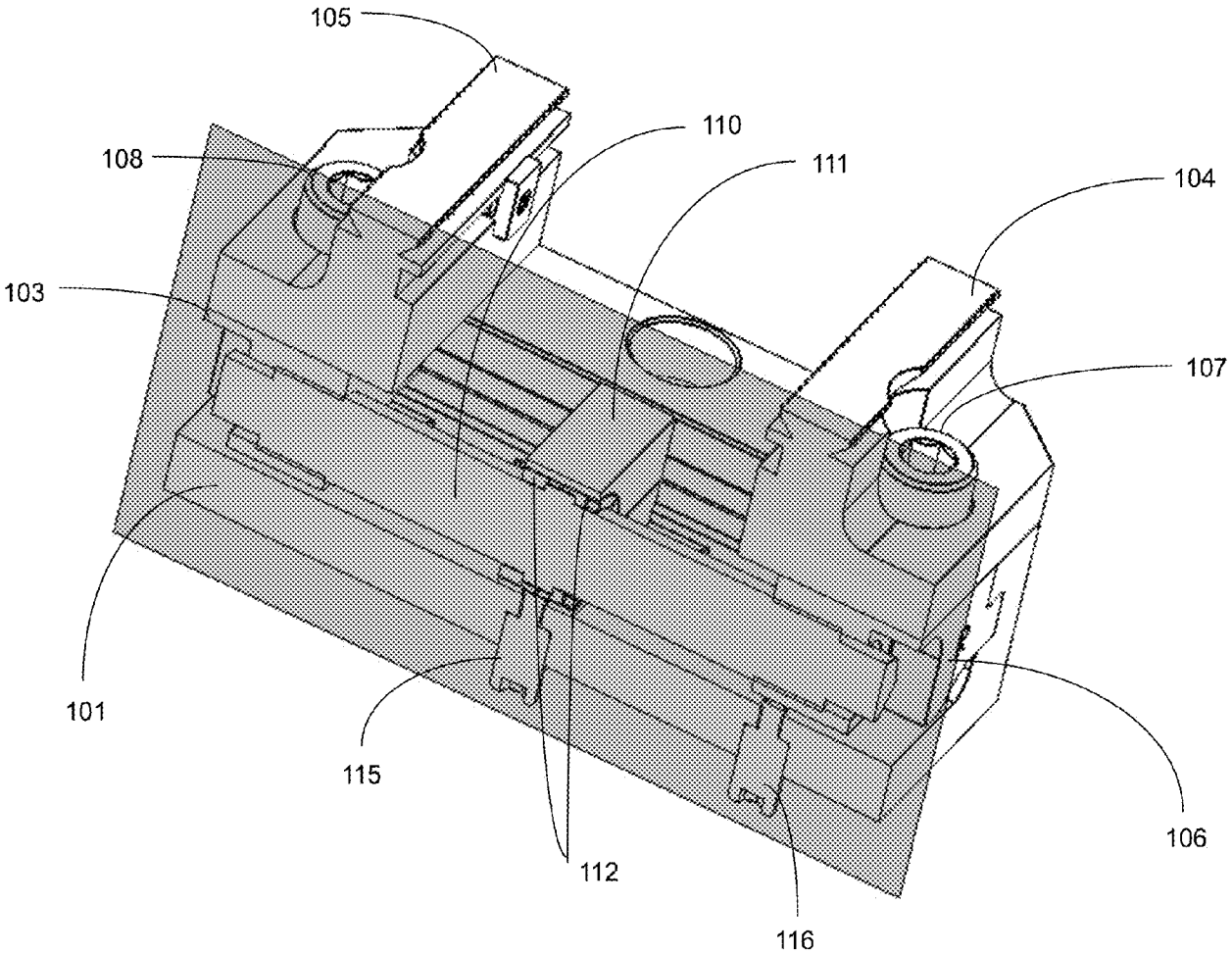
FIG. 8 is a cross-section view of the same fixture.

FIG. 8 shows a detailed cross-section of the fixture of FIG. 2 that shows the relative orientation of the internal elements. In particular, FIG. 8 shows how the threaded spindle 110 engages the sliding blocks 102 and 103 and how it is mounted within the central support 111 using externally threaded collars 112 which engage mating threads in the central support 111 and enclose a circumferential boss machined into the threaded spindle 110. By adjusting the positions of the threaded collars 112 it is possible to make a centering adjustment to the positions of the sliding blocks 102 and 103.

Figure 9A:
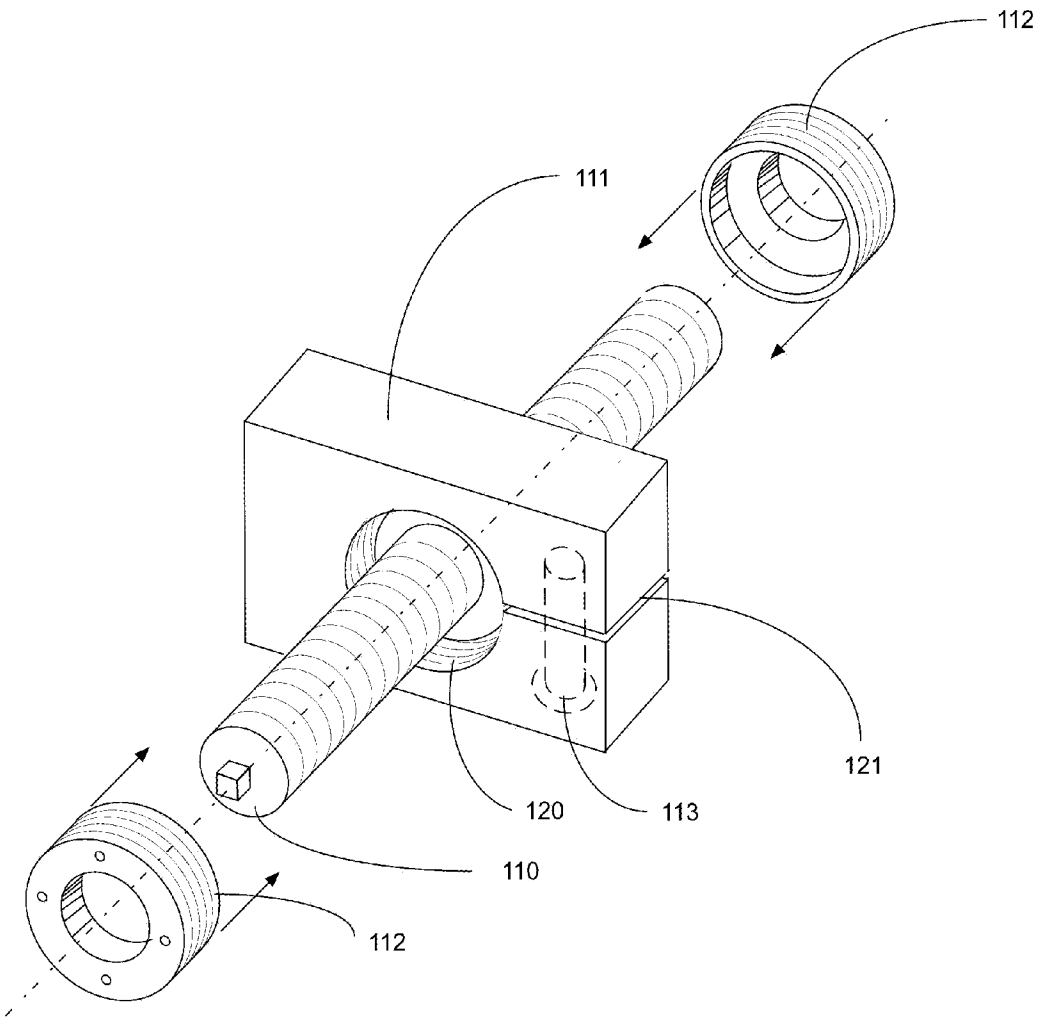
FIG. 9A shows the details of the spindle mounting.
Figure 9B:
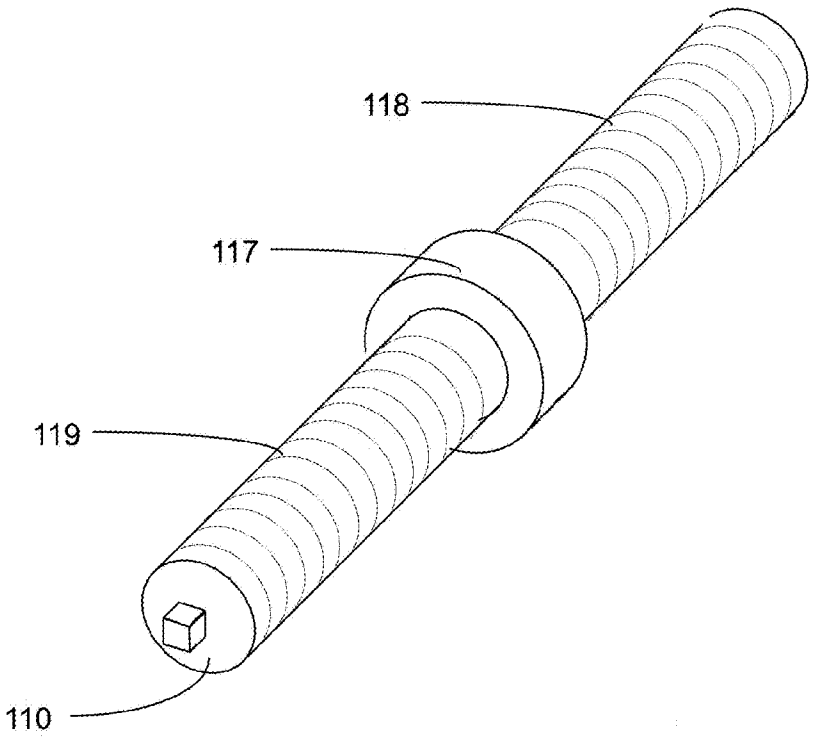
FIG. 9B shows the details of the threaded spindle of FIG. 9A.

FIGS. 9A and 9B show a more detailed illustration of the threaded spindle 110 having a central boss 117 and left-handed external thread 118 and right-handed external thread 119 regions. The central circumferential boss 117 on the threaded spindle 110 floats freely within central support 111 and the threaded collars 112 are screwed into mating internal threads 120 within the central support 111 and fully enclose the central circumferential boss 117. The longitudinal position of the threaded spindle within the central support can be adjusted by adjusting the positions of the threaded collars 112, thereby providing a centering adjustment to the positions of the sliding bocks 102 and 103. A gap 121 in one side of the central support 111 allows the adjustment of the collars 112 to be locked by tightening central support 111 mounting screw 113.

Figure 10:
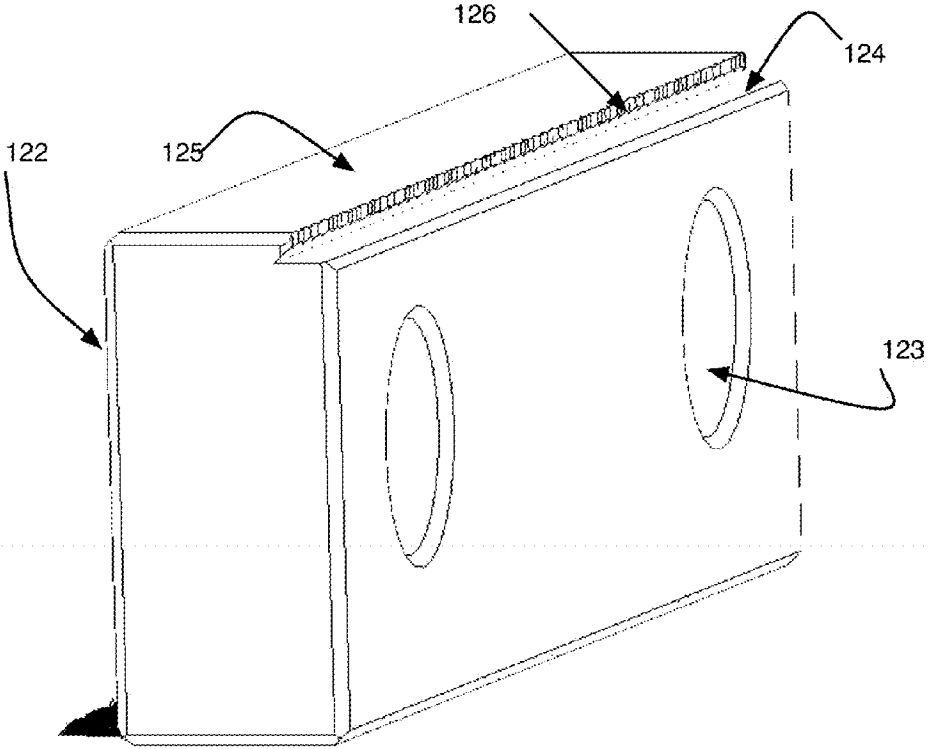
FIG. 10 shows an embodiment of jaws for a vise.
Figure 11A:
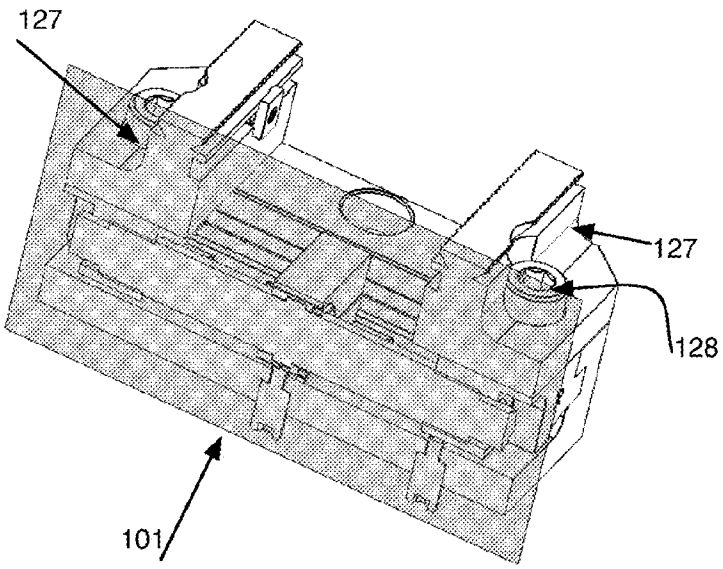
FIG. 11A shows a variation of the embodiment of FIG. 10.
Figure 11B:
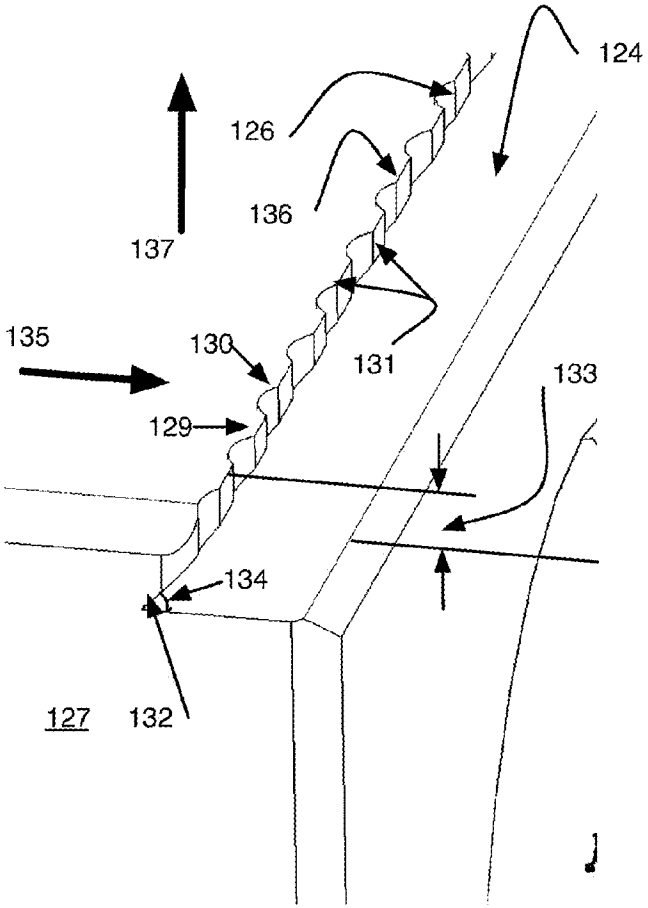
FIG. 11B shows details of the gripper jaw of the embodiment of 11A.
Figure 12:
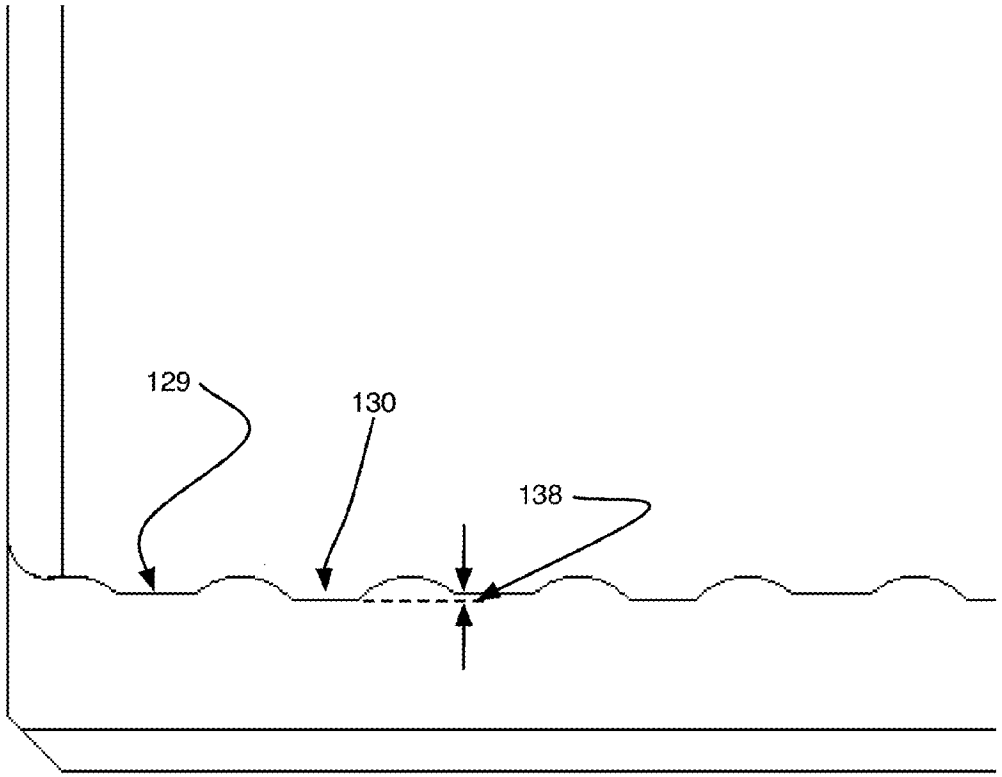
FIG. 12 shows a detail view of jaws for a vise.

In another variation shown in FIG. 10, a gripper jaw for a vise is seen. The jaw is a standalone unit that may be a part of a new vise and may be designed to retrofit early vises. In the variation shown mounting holes 123 are available to allow the jaws to be bolted to the vise. The attachment surface 122 is the back surface not visible in the view as shown. The gripper jaws include a reference surface 124 that is offset from the top surface 125. The edge of the top surface 126 includes serrations to aid in gripping the work piece (not shown). Details and a second variation of the gripper jaws are shown in FIG. 11. A vise 101 is seen to include a pair of gripper jaws 127 that are bolted 128 to the base of the vise. Note in this case, in contrast to that shown in FIG. 10, the gripper jaws are L-shaped and the bolt 128 and attachment surface of the gripper jaw are at right angles to the face of the gripper jaws. The detailed image of the gripper jaw show a reference surface 124 that is offset 133 from the top surface 125 of the jaw. The design of the jaw allows for effective gripping of the work piece without using significant surface area of the workpiece thus allowing milling or working of the piece to very near the edge. The offset may be adjusted based upon the strength of the grip required to hold the workpiece In a preferred embodiment the offset is approximately 0.010 inches. The edge that contacts and grips the workpiece is comprised of a series of serrations 126 at and edge that are set above the reference surface through a dovetail 132 cut into the top of the gripper jaw. The dovetail is cut at an angle 134 relative o the reference surface 124. An effect of the dovetail is to pull the workpiece down towards the reference surface 124 as the jaws are moved in the direction 135 to grip the workpiece. The angle 134 is selected on the basis of the material composition of the workpiece and is typically in the range of 20 to 70 degrees. In a preferred embodiment the angle is 45 degrees. The individual nibs 129, 130 of the serrations 126 are seen to include surfaces 131 that contact the workpiece. The shape of the contact surfaces 131 is seen to be rectangular with the long axis 136 of the rectangle oriented horizontally. This orientation has been found to provide increased gripping strength to avoid pulling the workpiece out of the vise in the vertical 137 direction. The rectangles 131 on adjacent nibs of the serration are seen to be of alternating sizes. This is effected by the alternating width of the nibs as best seen in FIG. 12. Adjacent nibs 129 and 130 are seen to vary in width thus creating an offset 138. The effect is that as the vise jaw is moved in the direction 135 to grip the workpiece the nib 130 will contact the workpiece surface before the nib 129. The amount of offset is selected on the basis of the material composition of the workpiece. In a preferred embodiment the offset is 0.001 inches. Note that as a result of the variation in the dimensions shown in FIG. 12 of the nibs 129 and 130, the rectangular gripping surface 131 (see FIG. 11) of the nib 129 is larger than that of nib 130.

SUMMARY

A tooling fixture that provides a self-centering vise to hold a work piece is described. The design provides a means to allow a centering adjustment of the clamping surfaces that is integrated into the central support structure for the threaded spindle. Additionally a design of a replaceable vise jaw used on the self-centering vise is shown to be useful on the current vise design as well as a retrofit on other vises.

Those skilled in the art will appreciate that various adaptations and modifications of the preferred embodiments can be configured without departing from the scope and spirit of the invention. Therefore, it is to be understood that the invention may be practiced other than as specifically described herein, within the scope of the appended claims.

What is claimed is:

1. A tooling fixture comprising:

a) a fixture body having guide structures, b) a threaded spindle mounted rotatably about a longitudinal axis thereof having a right-handed external thread in a first axial area and a left-handed external thread in a second axial area, said threaded spindle being provided with a central circumferential boss, c) a first sliding block screwed onto said right-handed external thread of said threaded spindle, said first sliding block including a vise clamping jaw on a top surface area, said first sliding block having sliding structures guided by said guide structures in said body and guided movably on said threaded spindle, d) a second sliding block screwed onto said left-handed external thread of said threaded spindle, said second sliding block including a vise clamping jaw on a top surface area, said second sliding block having sliding structures guided by said guide structures in said body and guided movably on said threaded spindle, e) a central support piece mounted on said body and located between said sliding blocks and rotatably connected to said central circumferential boss on said threaded spindle by externally threaded collars screwed into internal threads within said central support piece that engage said central circumferential boss allowing axial motion of said threaded spindle and adjustment of the longitudinal position of said threaded spindle with respect to said central support piece by adjusting the position of said threaded collars within said central support piece, f) wherein axial motion of said threaded spindle causes first and second sliding blocks to move towards each other or away from each other, and g) wherein adjustment of the longitudinal position of said threaded spindle causes said first and second sliding blocks to move in the same direction.

2. The tooling fixture of claim 1 the vise clamping jaw comprising:

a) a top surface, a gripping surface, a reference surface and an attachment surface b) where the gripping surface is perpendicular to the top surface, the reference surface is parallel to the top surface and offset from the top surface, and the gripping surface forms an edge of the top surface said edge located above the reference surface, c) said gripping surface is a serrated edge, said serrated edge comprised of a linear series of a plurality of nibs, said nibs having a rectangular surface to contact a workpiece held in the jaws of the vise, d) a dovetail cut located between the gripping surface and the reference surface e) where the vise jaw is attached to the body of a vise through contact of the attachment surface with a surface on the body of a vise and at least one bolt passing though the attachment surface and engaging a threaded hole in the body of the vise.

3. The tooling fixture of claim 2 wherein the nibs are not all the same size.

4. The tooling fixture of claim 3 wherein the serrated nibs alternate in size along the serrated edge said alternation being a pattern of: a larger nib, a smaller nib, a larger nib and so forth with the larger nibs being of the same size and larger than the smaller nibs which are of the same size.

* * * * *